US008464919B1

(12) United States Patent
Goozdich

(10) Patent No.: US 8,464,919 B1
(45) Date of Patent: Jun. 18, 2013

(54) INFANT CARRIER

(76) Inventor: Lee M. Goozdich, Pittsburgh, PA (US)

( * ) Notice: Subject to any disclaimer, the term of this patent is extended or adjusted under 35 U.S.C. 154(b) by 817 days.

(21) Appl. No.: 12/456,730

(22) Filed: Jun. 22, 2009

(51) Int. Cl.

| | |
|---|---|
| ***A61G 1/00*** | (2006.01) |
| ***A44B 11/00*** | (2006.01) |
| ***A47C 4/52*** | (2006.01) |
| ***A47C 31/00*** | (2006.01) |

(52) U.S. Cl.
USPC ..... 224/159; 224/158; 224/163; 297/256.16; 297/183.3

(58) Field of Classification Search
USPC ..... 224/158, 159, 163; 297/256.16, 297/256.17, 183.1, 183.3
See application file for complete search history.

(56) References Cited

U.S. PATENT DOCUMENTS

| | | | | |
|---|---|---|---|---|
| 1,464,404 | A | 8/1923 | Blekastad | 224/159 |
| 2,628,358 | A * | 2/1953 | Neils | 2/69.5 |
| 4,319,704 | A * | 3/1982 | Rosen | 224/270 |
| 4,516,806 | A * | 5/1985 | McDonald et al. | 297/452.13 |
| 4,634,177 | A * | 1/1987 | Meeker | 297/256.13 |
| 4,790,459 | A * | 12/1988 | Moseley | 224/159 |
| 4,901,898 | A | 2/1990 | Colombo et al. | 224/159 |
| 4,915,277 | A * | 4/1990 | Larreategui | 224/159 |
| 5,224,637 | A * | 7/1993 | Colombo | 224/159 |
| 5,267,680 | A * | 12/1993 | Torok | 224/158 |
| 5,333,769 | A * | 8/1994 | Skroski | 224/158 |
| 5,492,256 | A * | 2/1996 | Ive | 224/159 |
| 5,540,365 | A * | 7/1996 | LaMair | 224/158 |
| 5,567,008 | A * | 10/1996 | Cone, II | 297/256.16 |
| 5,711,466 | A * | 1/1998 | Kataoka et al. | 224/159 |
| D393,363 | S | 4/1998 | Kataoka | D3/215 |
| 5,775,770 | A * | 7/1998 | Tunney | 297/183.1 |
| 5,897,165 | A * | 4/1999 | Kucharczyk et al. | 297/256.17 |
| 6,017,088 | A * | 1/2000 | Stephens et al. | 297/256.16 |
| 6,186,381 | B1 | 2/2001 | Kernkamp | 224/161 |
| 6,354,475 | B1 | 3/2002 | Grace et al. | 224/158 |
| 6,367,875 | B1 * | 4/2002 | Bapst | 297/250.1 |
| 6,378,746 | B1 * | 4/2002 | Miller | 224/258 |
| 6,561,577 | B2 * | 5/2003 | Kelly | 297/183.2 |
| 6,789,710 | B1 | 9/2004 | Szatkowski | 224/159 |
| 6,926,181 | B1 | 8/2005 | Vath | 224/159 |
| D517,323 | S | 3/2006 | Raimondo et al. | D3/328 |
| 7,125,071 | B2 * | 10/2006 | Aiudi | 297/4 |
| 7,188,897 | B2 | 3/2007 | Patrizi et al. | 297/250.1 |
| 7,270,372 | B2 | 9/2007 | Robertson | 297/183.6 |
| 7,575,136 | B2 * | 8/2009 | Kernkamp | 224/159 |
| 7,686,195 | B2 * | 3/2010 | Bangert | 224/159 |
| 7,770,970 | B2 * | 8/2010 | Hei et al. | 297/256.12 |
| 7,810,682 | B2 * | 10/2010 | Balensiefer et al. | 224/158 |
| 7,841,653 | B2 * | 11/2010 | Sanchez | 297/183.3 |
| 2006/0261105 | A1 * | 11/2006 | Balensiefer et al. | 224/159 |
| 2007/0029356 | A1 * | 2/2007 | Moriguchi et al. | 224/160 |
| 2007/0246493 | A1 * | 10/2007 | Kernkamp | 224/159 |

* cited by examiner

*Primary Examiner* — Justin Larson
*Assistant Examiner* — Peter Helvey
(74) *Attorney, Agent, or Firm* — Price & Adams

(57) ABSTRACT

An adjustable belt forms a loop around the body of the person at predetermined vertical position. The belt has a pair of releasable fasteners and a post. The belt fasteners are positioned at each end of the belt with the ability to connect to one another within a range of predetermined locations to adjust the diameter of the loop. A carrier receives and supports the baby. The carrier has a receptacle for receiving the belt post and a handle to facilitate gripping by the person. The carrier receptacle is positioned on the carrier for receiving the post to connect the carrier to the belt in a predetermined relation so that the baby is positioned at the ergonomic position substantially over the center of gravity and around the waist of the person so that the weight of the carrier is not concentrated at the lower back of the person.

15 Claims, 4 Drawing Sheets

INFANT CARRIER

BACKGROUND OF THE INVENTION

1. Field of the Invention

This invention relates to an infant carrier and, more particularly, to an apparatus and method for carrying a baby at a preselected ergonomic position by a person.

2. Description of the Related Art

The use of carriers for children is well known. Child carriers conventionally include a base or body coupled to a pivotal handle. In many embodiments, the base is specifically designed for attachment and detachment to an interior frame of an automobile.

One disadvantage associated with conventional devices is the orientation of the body of the carrier and the handle pivotally coupled thereto. Existing designs make it difficult and awkward to hold or transport the carrier by hand, especially for a substantial length of time. It is well known to provide a sling or similar device to transfer the weight of the carrier to the shoulder of a user. Such prior art slings, however, also have disadvantages.

U.S. Pat. No. 4,901,898 discloses an infant carrier that is worn around the waist of an adult. The carrier includes a belt and a molded member. The molded member defines a molded seat and a slot for receiving the belt. The seat cannot be disengaged or disconnected from the belt once the belt is wrapped around a person.

U.S. Pat. No. Des. 393,363 discloses an ornamental design for a baby holder. The holder includes a belt that connects to a seat portion. The seat portion cannot be disengaged or disconnected from the belt once the belt is wrapped around a person.

U.S. Pat. No. Des. 517,323 discloses an ornamental design for an infant carrier support holder. The holder includes a slightly curved portion and a j-shaped hook portion projecting outwardly from the curved portion.

U.S. Pat. No. 7,188,897 discloses an infant carrier that includes a carrier shell and a harness system. The carrier shell includes a seating area for a child. The harness system is adapted to connect to the carrier shell and is adjustable between a first configuration for a smaller child and a second configuration for a larger child. The harness system relies upon shoulder straps.

U.S. Pat. No. 7,270,372 discloses an infant carrier frame. The frame includes a pivotally attached handle and several additional handles. The additional handles provide parents with many options in lifting and carrying the frame.

U.S. Pat. No. 6,186,381 discloses a child carrier for carrying a child on the chest, back, or hip of the wearer. The carrier includes a belt that wraps around the torso of the wearer. The belt includes a seat that projects outwardly from the belt transversely. The carrier also includes shoulder straps that distribute the weight toward the chest of the wearer.

U.S. Pat. No. 6,789,710 discloses a baby seat carrier. The carrier includes a belt and a seat portion. The seat portion includes a sleeve that includes a slot for receiving the belt. After the belt is inserted into the sleeve, the belt wraps around the torso of the person who is carrying the baby. The seat portion cannot be disengaged or disconnected from the belt once the belt is wrapped around a person.

U.S. Pat. No. 6,354,475 discloses an ergonomically designed infant carrier that includes a container and a handle. The handle is designed to be lifted by hand or to be carried over the shoulder.

U.S. Pat. No. 6,926,181 discloses a child carrier transport system. The system includes a pair of belts and a child carrier.

One of the belts is secured around the waist of the user. The second belt wraps around the carrier. The first belt includes a pad that connects the first belt to the second belt.

U.S. Pat. No. 1,464,404 discloses a baby carrier that includes a belt, a seat, and a connecting apparatus that includes a plate, a slot, and a pair of buttons. The belt is inserted through the slot, so that it can be worn around the waist of the carrier. The buttons protrude from the plate to engage a pair of key-hole slots on the seat.

Many of the existing child carrying systems disclose baskets with arching handles that extend over the basket. However, these baskets are not designed to be optimally positioned in relation to the body of the carrier. Accordingly; there is a need for an improved child carrying system.

SUMMARY OF THE INVENTION

In accordance with the present invention there is provided a baby carrier assembly adapted to carry a baby at a preselected ergonomic position by a person. A belt extends in a loop around the body of the person. The belt has opposite ends with releasable fasteners attached thereto. A post extends from the belt between the opposite ends. The belt fasteners are connectable to one another within a range of predetermined locations to adjust the diameter of the loop. A carrier for receiving and supporting the baby. The carrier has a receptacle for receiving the post to connect said carrier to the belt so that the baby in the carrier is positioned at the preselected ergonomic position substantially over the center of gravity of the person.

Further in accordance with the present invention, there is provided an ergonomic infant carrier. A belt has opposite ends. Each end has a connector positioned thereon. The connectors releasably attach to one another so that the belt extends in a loop for wrapping around the body of a person at a preselected first vertical position relative to the person. A seat is provided for supporting a child at a preselected second vertical position relative to the person. The seat has a handle for gripping by the person. The belt is releasably connected to the seat to preserve a predetermined relationship between the first vertical position and the second vertical position to minimize the distance from the child to the center of gravity of the person.

Further in accordance with the present invention, there is provided a method for carrying a baby that includes of the step of releasably attaching opposite ends of a belt to form a loop having a diameter selected for positioning the loop at a first vertical position around a person. A baby carrier having a handle for gripping by the person is provided. The baby is supported at a second vertical position with the baby carrier in a predetermined relation to the first vertical position. The carrier is releasably connected to the loop to hold the baby at a predetermined distance from the center of gravity of the person.

Accordingly, a principal object of the present invention is to provide an ergonomic baby carrier.

Another object of the present invention is to provide an improved method for carrying a baby.

Another object of the present invention is to provide a baby carrying device that releasably connects to a person.

Another object of the present invention is to provide an infant carrier that supports an infant in a position that reduces the strain applied to the lower back of the person holding the carrier.

A further object of the present invention is to provide a baby carrying device that minimizes the distance between the baby and the center of gravity of the person holding the device.

These and other objects of the present invention will be more completely described and disclosed in the following specification, accompanying drawings, and appended claims.

DESCRIPTION OF THE PREFERRED EMBODIMENTS

Figure 1:
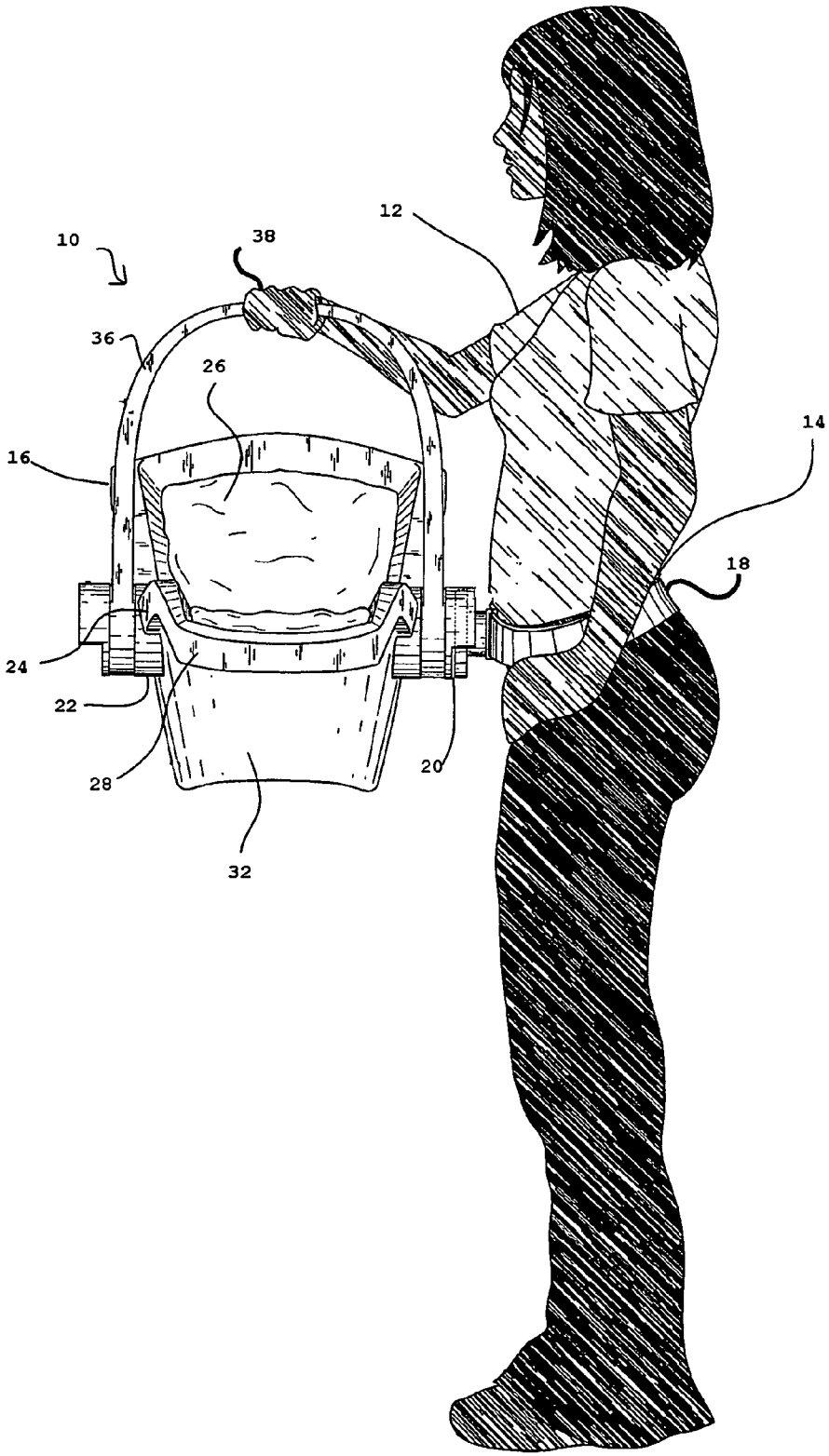
FIG. 1 is a view in side elevation of a person ergonomically connected to a baby carrying device.

Referring to the drawings and, particularly, to FIG. 1, there is shown an ergonomic infant carrier assembly generally designated by the numeral 10. The infant carrier 10 is constructed to support the weight of a seated infant (not shown) at a preselected position on the waist and closer to the center of gravity of a person 12 for the purpose of reducing the amount of strain applied to the lower back 14. The position of the carrier assembly 10 relative to the person 12 reduces the muscular effort that is required to carry the infant. The carrier assembly 10 is particularly useful for individuals having lower back problems.

The carrier assembly 10 includes a carrier 16 and an adjustable belt 18 that wraps around the waist of the person 12. The belt 18 extends in a loop around the body of the person/user. The diameter of the loop is variable to enable the belt to be positioned at different heights along the torso of the person 12, preferably at the waist or belt line. The belt. 18 includes a fastening device or fastener 20 that connects the carrier 16 to the belt 18. Preferably, the person 12 is a woman so that the belt 18 is in a preselected position to optimize the relation between the center of gravity of the woman 12 and the carrier 16. This arrangement allows the carrier 16 to be positioned as close as possible to the body of the woman 12 at the waist, as shown in FIG. 1.

Initially, the person 12 has to bend her back to grasp the carrier 16 holding the infant. After the person 12 grasps the carrier 16, the person 12 straightens into an upright, standing position to raise the carrier 16 and the infant to a preselected vertical position. Next, the person 12 moves the carrier 16 to a position on the belt 18.

As shown in FIG. 1, the belt 18 engages the carrier 16 to hold the infant at an ergonomically desirable position on the waist, as close as possible to the body of the person, to minimize back strain for the person 12. Preferably, the carrier 16 releasably attaches to the belt 18, so that the carrier 16 has the ability to disconnect from the belt 18 in a rapid manner. This also serves to transfer the weight of the carrier 16 to the belt 18 and therefrom uniformly around the waist of the person 12, removing concentration of the weight from the back of the person.

Figure 2:
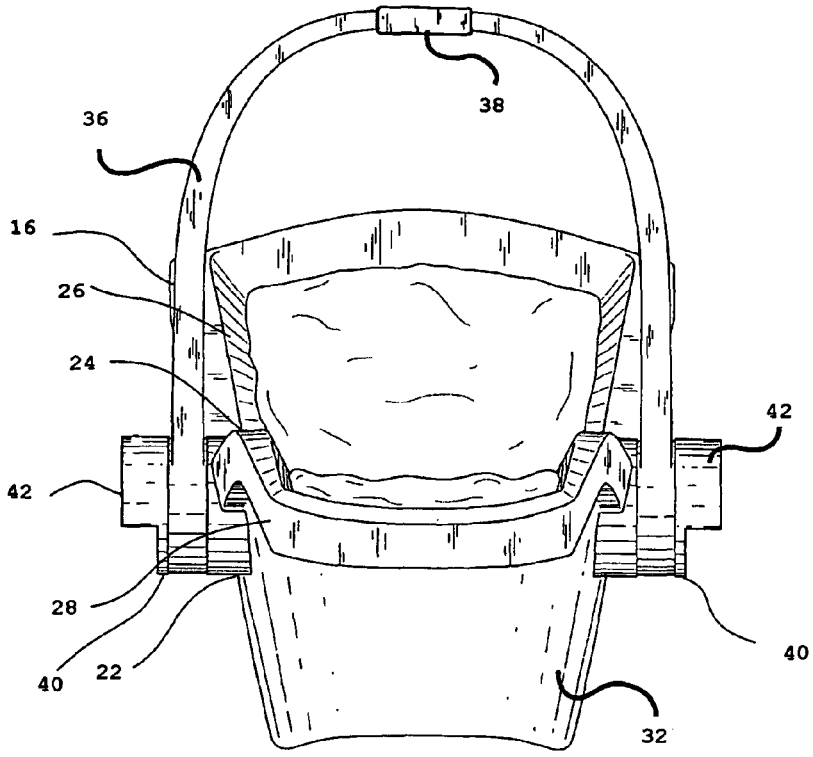
FIG. 2 is a front view of the a baby carrying device shown in FIG. 1.
Figure 3:
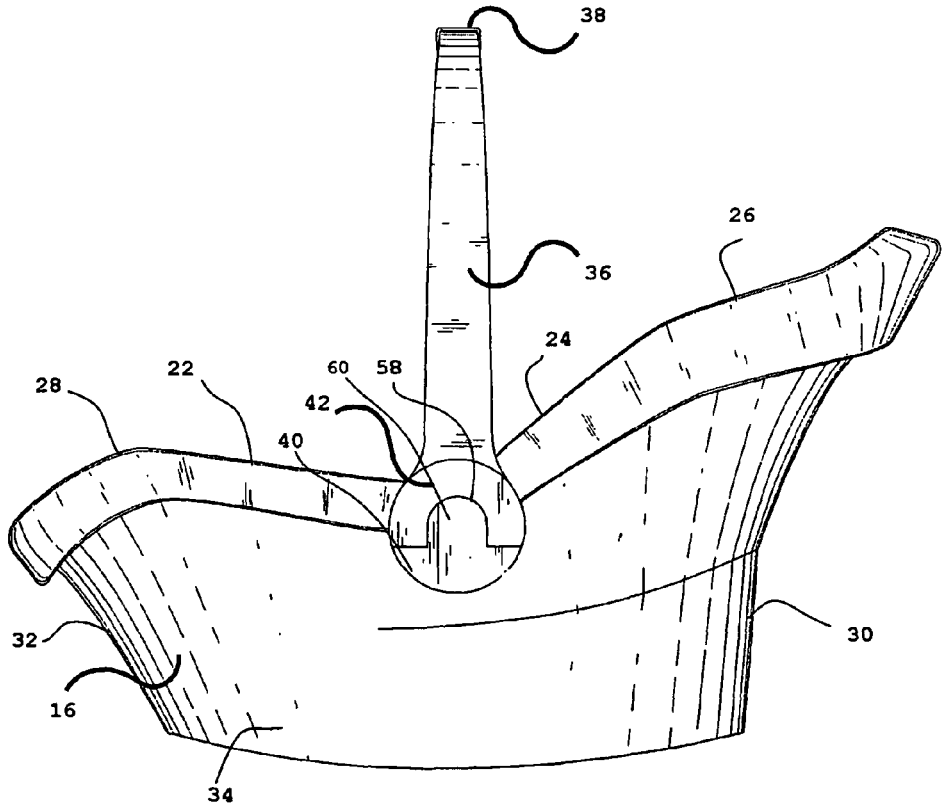
FIG. 3 is a view in side elevation of the baby carrier shown in FIG. 1.

Referring now to FIGS. 2-3, the carrier 16 includes a shell-like frame 22 that essentially forms a basket 24 for receiving and supporting an infant. The basket 24 includes at one end an upper portion 26 that forms a back for supporting the infant and at an opposite end a lower portion 28 that forms a base for cradling the infant. Optionally, the upper portion 26 is pivotally connected to the lower portion 28 to provide for adjustments in the support of the infant.

The base 28 includes an inverted dome-shaped or cupped upper surface that essentially conforms to cradle the infant. The base 28 also includes a head end 30, a foot end 32, a pair of peripheral surfaces 34 that connect the head end 30 to the foot end 32. Preferably, the head end 30, the foot end 32, and the peripheral surfaces 34 form an essentially annular, tapered skirt that extends around the lower portion 28 that supports the frame 22 when the carrier 16 is placed on the ground or other essentially flat surfaces.

The carrier 16 also includes a handle 36 that is attached to and extends above and across the frame 22. Preferably, the handle 36 is pivotally connected to the frame 22 with the ability to be positioned at various positions above, in front of, or to the side of the infant. The handle 36 includes a gripping portion 38 to facilitate gripping or manual manipulation by the person 12 shown in FIG. 1.

As shown in FIGS. 2-3, the carrier 16 includes a pair of disc-shaped brackets 40 that include U-shaped recesses or receptacles 42 for receiving the fastening device 20 shown in FIG. 1. The receptacles 42 facilitate the releasable connection of the carrier 16 to the belt 18. Preferably, the releasable connection provides for the rapid connection and disconnection of the carrier 16 to the belt 18 on the body of the person 12, as shown in FIG. 1.

Figure 4:
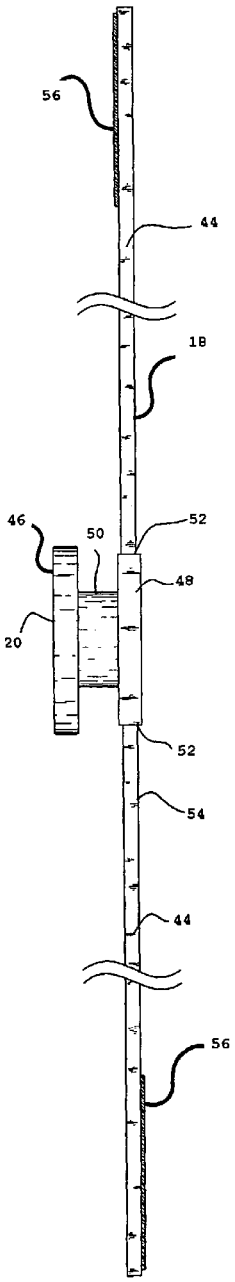
FIG. 4 is a top plan view of a belt for connecting the baby carrying device to a person.
Figure 5:
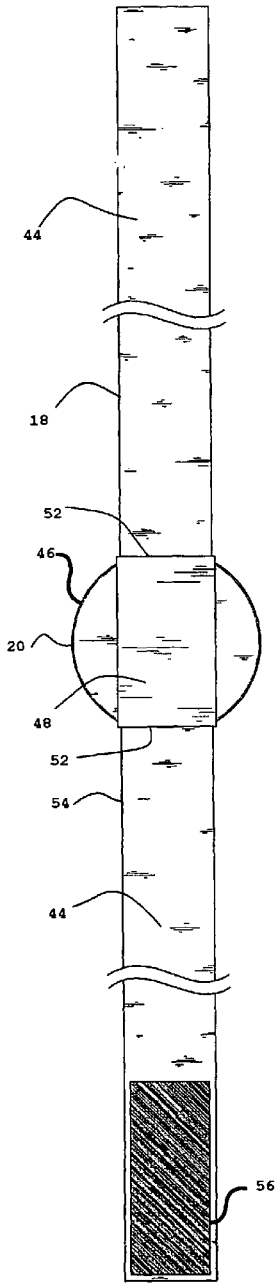
FIG. 5 is a rear view in side elevation of the belt shown in FIG. 4.
Figure 6:
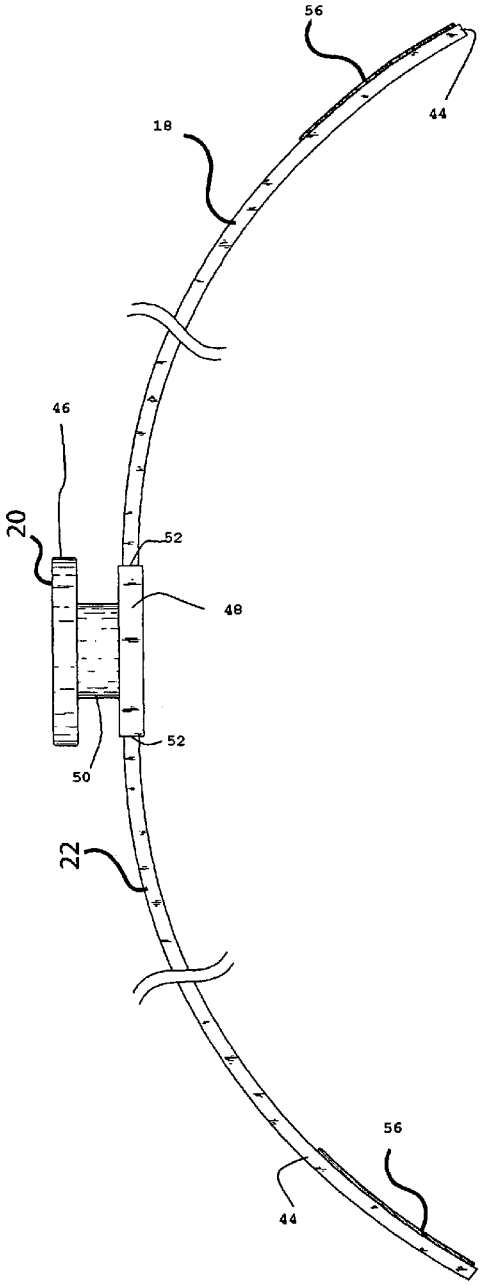
FIG. 6 is a top plan view of the belt shown in FIG. 4, illustrating the belt in an arcuate position.

Referring now to FIGS. 4-6, the belt 18 includes the fastening device 20 centered on the belt 18 and a pair of essentially flat end flaps 44 extending from each side of the fastening device 20. The fastening device 20 includes disc-shaped knob 46, flat base 48, and cylindrical post 50 connecting the knob 46 to the base 48. The post 50 has sufficient depth to allow for easy releasable connection of the carrier 16 to the belt 18, shown in FIG. 1. Preferably, the base 48 defines a slot 52, shown in FIGS. 4-6. The flaps 44 are integral to one another to form an essentially continuous strap 54 that slides through the slot 52 in the base 48.

Each end flap 44 includes a connecting portion 56 that connects to one another within a predetermined range of positions to form loops of varying diameters from the strap 54. The dimensions of the straps are preselected to allow the belt 18 to wrap around most adults. The length of each connecting portion 56 is preselected to provide a certain degree in adjustability in the diameter of the loops. Preferably, the length of the belt 18 is sufficient to allow the belt 18 to wrap around the carrier 16 for storage when the belts 18 are not wrapped around the person 12.

As shown in FIGS. 4-6, the connecting portions 56 include any suitable connecting devices. The connecting portions 56 include any suitable releasable fasteners that mate with one another to facilitate connection. In one example, the fastening devices are conventional hook-and-loop fasteners commonly identified by the trademark Velcro®.

The ability to vary the diameter of the loops provides the wearer with the ability to position the belt 18 at different vertical positions on the body of the wearer. Preferably, the wearer will position the belt 18 at a preselected, optimal height that is closest to the center of gravity of the wearer. This position reduces lower back strain because the weight of the infant in the carrier is transferred to the midriff of the person and is directed away from the lower back of the person. This provides for greater ease in holding the carrier 16 shown in FIG. 1 with an infant and prevents back pain from prolonged use.

The connecting portions 56 are positioned at opposite ends of the belt 18. The belt 18 is wrapped around a person 12 in the manner shown in FIG. 1 forming a loop. The loop has a preselected diameter that allows the belt 18 to be positioned a first vertical position on the person 12.

As shown in FIGS. 1-6, the person grips the handle 36 that is pivotally connected to the carrier 16. The carrier supports the infant at a second vertical position. The fastening device 20 releasably connects to the receptacle 42 to hold the infant in a predetermined relation to center of gravity of the person 12.

The carrier 16 and the belt 18 are fabricated from any suitable materials using conventional manufacturing techniques. Suitable materials include metals, ceramics, plastics, and composites. Preferably, the carrier 16 is made from an essentially rigid material and the belt strap 54 is made from a material having sufficient flexibility and durability for repeated wrapping around the person 12 or the carrier 16.

Figure 8:
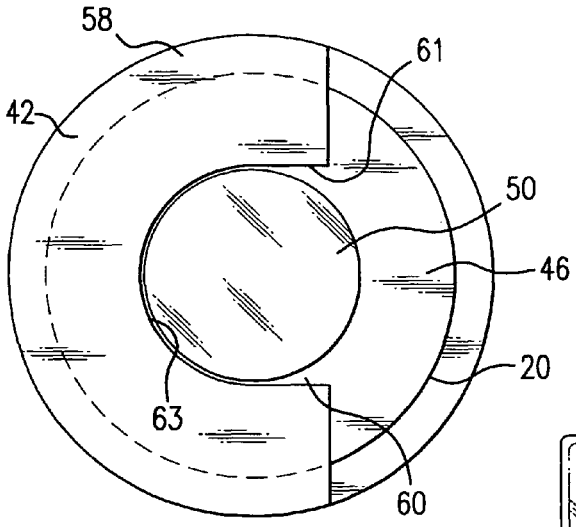
FIG. 8 is a view in side elevation of the belt fastening device positioned in the carrier receptacle.
Figure 9:
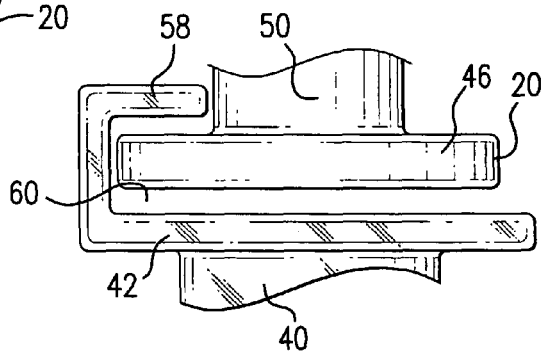
FIG. 9 is a fragmentary view in side elevation of the belt fastening device positioned in the carrier receptacle.
Figure 7:
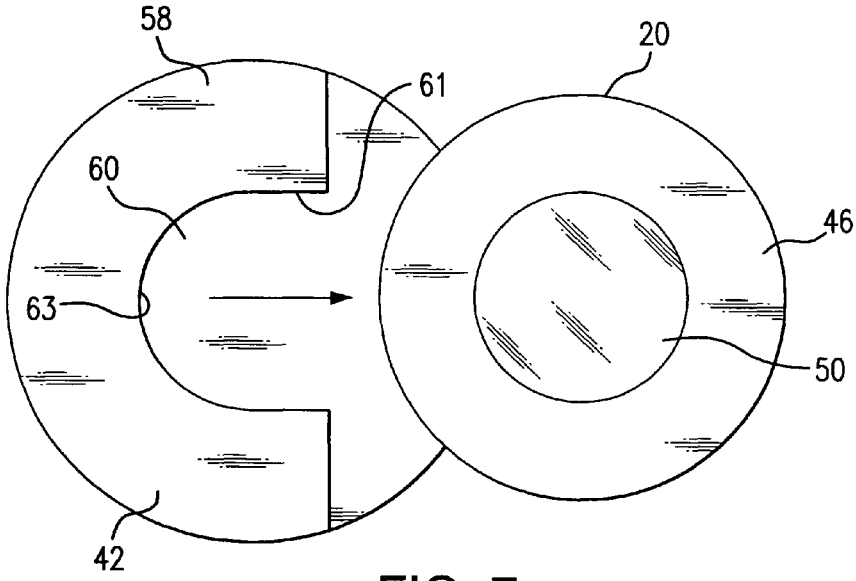
FIG. 7 is an exploded view in side elevation of the belt fastening device displaced from the carrier receptacle.

Referring now to FIGS. 7-9, the releasable connection of the fastening device 20 to the receptacle 42 is shown. The receptacle 42 includes an essentially U-shaped flange 58 that defines a pocket 60 having an open end portion 61 and a closed end portion 63 for receiving the knob 46. In the first step, the pocket 60 is aligned in an overlying relation to receive the knob 46, as shown in FIG. 7.

In the second step, the knob 46 slides through the pocket open end portion 61 along the line of the arrow shown in FIG. 7 into the pocket 60 until the post 50 contacts the flange 58. In the third step, the flange 58 frictionally engages the knob 46 and the post 50 to retain the fastening device 20 within the pocket closed end portion 63 of the receptacle 42, as shown in FIG. 8. In this manner the carrier 16 is connected to the belt 18 on the waist of the person. The weight of the carrier 16 is transferred directly to the waist. The weight of the carrier 16 is not supported at a distance from the waist. Thus, the weight is transferred from the belt 18 uniformly around the waist and is not concentrated at the lower back 14 of the person 12.

The geometry of the knob 46 and the pocket 60 are not critical provided that the geometry provides for the releasable connection and retention of the knob 46 within the pocket 60. In an alternative embodiment, the knob 46 is a ball-shaped and the pocket 60 is configured to receive a ball-shaped object for rapid connection and disconnection of the belt 18 to the carrier 16 shown in FIG. 1.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A baby carrier assembly adapted to carry a baby at a preselected ergonomic position by a person comprising:

a belt extending in a loop around the body of the person, said belt having opposite ends with releasable fasteners attached thereto, a post extending from the belt between said opposite ends, said post including a cylindrical portion and a disc-shaped portion, said cylindrical portion connected to and extending from said belt, said disc-shaped portion extending from said cylindrical portion, said belt fasteners connectable to one another within a range of predetermined locations to adjust the diameter of said loop, a carrier for receiving and supporting the baby, said carrier having a receptacle including an open end portion and a closed end portion, said post being slideable through said receptacle open end portion to said closed end portion for retention in said receptacle to releasably connect said carrier to said belt, said carrier when in a first position of use is disconnected from said belt, and said carrier movable to a second position of use releasably connected to said belt by the engagement of said post in said receptacle closed end portion so that the baby in said carrier is positioned at the preselected ergonomic position substantially over the center of gravity of the person.

2. A baby carrier assembly as set forth in claim 1 which includes:

a handle extending from said post to facilitate gripping by the person, and said handle being pivotal relative to said carrier.

3. A baby carrier assembly as set forth in claim 1 in which:

said releasable fasteners include hook-and-loop fasteners.

4. A baby carrier assembly as set forth in claim 1 in which:

said carrier includes a base for supporting the baby, a head end and a foot end extending from opposite sides of the base, and a pair of oppositely positioned peripheral surfaces for connecting said head end to said foot end, and said head end, said foot end, and said peripheral surfaces being connected to said base to surround the baby in said carrier.

5. A baby carrier assembly as set forth in claim 1 in which:

said carrier receptacle includes a U-shaped portion having said open end portion for receiving said cylindrical portion for sliding movement to said closed end portion to connect said carrier to said belt.

6. A baby carrier assembly as set forth in claim 5 which includes:

said disc-shaped portion retaining said cylindrical portion engaged to said carrier receptacle U-shaped portion.

7. A baby carrier assembly as set forth in claim 1 which includes:

said carrier receptacle being positioned on said carrier for receiving said post to connect said carrier to said belt so that the baby is positioned at the ergonomic position to minimize the distance to the center of gravity of the person.

8. A baby carrier assembly as set forth in claim 1 which includes:

said belt having sufficient length to wrap around the carrier to facilitate storage of the baby carrier assembly.

9. An ergonomic infant carrier comprising:

a belt having opposite ends, each end having a connector positioned thereon, said connectors releasably attaching to one another so that said belt extending in a loop for wrapping around the body of a person at a preselected first vertical position relative to the person, a post extending from said belt between said opposite ends, said post including a cylindrical portion and a disc-shaped portion, said cylindrical portion connected to and extending from said belt, said disc-shaped portion extending from said cylindrical portion, a seat for supporting a child at a preselected second vertical position relative to the person, said seat having a handle for gripping by the person, said seat including a receptacle having an open end portion and a closed end portion, said post being slideable through said receptacle open end portion to said closed end portion for retention in said receptacle, and said seat movable between a first position removed from connection to said belt while supporting a child and a second position with said post in said receptacle closed end portion to connect said seat to said belt to preserve a predetermined relationship between the first vertical position and the second vertical position to minimize the distance from the child to the center of gravity of the person.

10. An ergonomic infant carrier as set forth in claim 9 which includes:

said handle being pivotally connected to said seat.

11. An ergonomic infant carrier as set forth in claim 9 in which:

said seat includes a base for supporting the child, a head end and a foot end extending from opposite ends of the base, and a pair of oppositely positioned peripheral surfaces for connecting said head end to said foot end, and said head end, said foot end, and said peripheral surfaces being connected to said base to surround the child in said carrier.

12. An ergonomic infant carrier as set forth in claim 9 which includes:

means for releasably attaching said connectors to one another.

13. An ergonomic infant carrier as set forth in claim 9 which includes:

at least one of said connectors having the ability to attach to the other connector within a predetermined range of positions to adjust the diameter of the belt loop.

14. An ergonomic infant carrier as set forth in claim 9 which includes:

said seat includes means for enclosing the child.

15. An ergonomic infant carrier as set forth in claim 9 in which:

said belt has sufficient length to wrap around said seat for storage.

* * * * *